US005907349A

United States Patent [19]

Shimizu et al.

[11] Patent Number: 5,907,349

[45] Date of Patent: May 25, 1999

[54] FLUORESCENT PRINTER HEAD

[75] Inventors: Yukihiko Shimizu; Masao Saito; Kinya Ueda, all of Mobara, Japan

[73] Assignee: Futaba Denshi Kogyo K.K., Mobara, Japan

[21] Appl. No.: 08/845,140

[22] Filed: Apr. 21, 1997

[30] Foreign Application Priority Data

Apr. 19, 1996 [JP] Japan ..... 8-098587

[51] Int. Cl.[6] ..... B41J 2/447; H01J 1/52

[52] U.S. Cl. ..... 347/238; 347/122; 313/492

[58] Field of Search ..... 347/238, 122, 347/121; 345/47; 313/492, 306, 307, 308, 497, 352

*Primary Examiner*—N. Le
*Assistant Examiner*—Lamson D. Nguyen
*Attorney, Agent, or Firm*—Oblon, Spivak, McClelland, Maier & Neustadt, P.C.

[57] ABSTRACT

A fluorescent printer head capable of being subject to dynamic driving to reduce the number of ICs required. A shield electrode is provided between anode arrays having anode dots arranged in an offset manner and control electrodes are respectively arranged for the anode arrays. The anode arrays are subject to dynamic driving and selected by the control electrodes. Such construction of the fluorescent printer head ensures smooth selection of the anode arrays during the dynamic driving. Also, it eliminates non-uniformity in luminance of the anode dots of the anode arrays and accomplishes downsizing of the printer head and a reduction in manufacturing cost thereof due to a reduction in the number of ICs required.

6 Claims, 6 Drawing Sheets

FLUORESCENT PRINTER HEAD

BACKGROUND OF THE INVENTION

This invention relates to a fluorescent printer head for optical writing to which a luminous principle of a fluorescent display device is applied, and more particularly to a fluorescent printer head adapted to be applied to various optical printers used for writing on a photosensitive drum, writing on a photosensitive film and the like.

A conventional fluorescent printer head of the static drive type is typically constructed in such a manner as shown in FIG. 6. The conventional fluorescent printer head which is generally designated by reference numeral 100 in FIG. 6 includes a light-permeable anode substrate 101, side plates 102 and a rear substrate 103, which are jointed to each other by means of sealing glass to provide an envelope 104. The envelope 104 thus formed is then evacuated to a high vacuum. The anode substrate 101 is provided on an inner surface thereof with two rows of anodes or two anode arrays 105, each of which is constructed of a plurality of anode dots arranged at predetermined intervals. The two anode arrays 105 are arranged so as to be parallel to each other and spaced from each other at a predetermined interval in a direction perpendicular to a longitudinal direction of the anode arrays 105. Also, the anode arrays 105 are so arranged that the anode dots of one of the anode arrays 105 and those of the other anode array 105 are kept from being aligned with each other with a space being interposed between the anode arrays 105. In other words, the anodes dots of the anode arrays 105 opposite to each other are arranged in an offset manner.

The fluorescent printer head 100 thus constructed is of the static drive type, wherein a ratio of the number of anode dots of each of the anode arrays 105 to the number of output bits of each of ICs 106 corresponding thereto is set to be 1:1. More particularly, the anode dots are electrically separated from each other and led out of the arrays by means of wiring conductors arranged on the anode substrate 101. The ICs 106 each acting as a driver for anode driving are arranged on the anode substrate 101 in a manner to be positioned outside the anode arrays 105 corresponding thereto. The wiring conductors led out of the anode dots are connected to terminals of the ICs 106 corresponding thereto, respectively.

The envelope 104 has two filamentary cathodes 107 stretchedly arranged therein in a manner to extend along the anode arrays 105 above the anode arrays, respectively. Also, the envelope 104 is provided therein with shield electrodes 108, which are respectively positioned outside the anode arrays 105, to thereby prevent electrons discharged from the cathodes 107 toward the anode arrays from being impinged on the ICs 106.

Driving of the fluorescent printer head 100 thus constructed is carried out by driving the ICs 106 to feed each of the anode dots of the anode arrays 105 with a display signal. Luminescence of the anode dots is forwardly guided through the light-permeable anode substrate 101.

In the conventional fluorescent printer head shown in FIG. 6, the ICs 106 are arranged in the envelope 104. Alternatively, the fluorescent display device may be often constructed so that the anode substrate 101 constituting a part of the envelope 104 is formed into a size somewhat larger than an outer configuration of the envelope 104 and the ICs 106 are arranged on a portion of the anode substrate 101 outwardly extending from the envelope 104. Also, the driver ICs 106 and connection terminals may be arranged on a resin tape and then connected through anisotropic conductive members to anode wirings led out to both sides of the envelope of the fluorescent printer head, resulting in the fluorescent printer head being constructed into a module structure.

As will be noted from the above, in the fluorescent printer head 100 of the static drive type, not only the number of ICs required is increased but each of the ICs 106 acting as the driver for anode driving is increased in the number of output bits. The driver IC 106 accounts for a large part of a manufacturing cost of the fluorescent printer head 100. Thus, the conventional fluorescent printer head fails to be reduced in manufacturing cost or price.

Also, employment of either the structure wherein the driver ICs 106 are arranged in the envelope 104 or the structure wherein the ICs are arranged on the portion of the anode substrate 101 outside the envelope renders downsizing of the fluorescent printer head highly difficult. Further, the structure wherein the tape having the ICs arranged thereon is connected to the anode wirings led out to both sides of the envelope substantially hinders downsizing of the fluorescent printer head which is constructed into a module.

In order to avoid such disadvantages of the prior art described above, the inventors considered dynamic driving of the fluorescent printer head and, as a result, it was found that there exists a problem to be solved. More particularly, when the fluorescent printer head including two anode arrays wherein the anode dots are arranged in an offset manner is so constructed that each adjacent two anode dots between the anode arrays opposite to each other are connected to each other to reduce the number of bits of the anode driver to half, resulting in the anodes being driven while reducing a duty ratio to half, the number of bits required for the IC may be reduced to half. Unfortunately, this requires to arrange an electrode structure which permits any one of the two anode arrays to be selected in synchronism with driving of the anodes.

For the purpose of selection of any one of the anode arrays, it would be considered to arrange a control electrode between each of the cathodes and each of the anode arrays. For example, a control electrode which has been conventionally commonly used for a fluorescent display device is constructed into a mesh-like structure, a wire-like structure or the like.

The mesh-like control electrode has a disadvantage of causing a shade to be formed on a luminous section, leading to a variation in light quantity of the fluorescent printer head. Also, the conventional fluorescent printer head causes an interval between the anode arrays to be reduced, so that it is highly difficult to arrange two mesh-like control electrodes in a manner to keep the electrodes from being contacted with each other. Further, application of a cut-off voltage to one of the anode arrays while selecting the other anode array tends to hinder flowing of electrons into the anodes to be selected. The wire-like control electrode encounters, in addition to the above-described disadvantages of the mesh-like control electrode, a further disadvantage that it is required to increase positional accuracy in alignment between the anode dots and the wire-like control electrode.

SUMMARY OF THE INVENTION

The present invention has been made in view of the foregoing disadvantages of the prior art.

Accordingly, it is an object of the present invention to provide a fluorescent printer head which is capable of realizing dynamic driving thereof.

It is another object of the present invention to provide a fluorescent printer head which is capable of reducing the number of ICs required, to thereby accomplish downsizing of the fluorescent printer head and a reduction in manufacturing cost thereof.

In accordance with the present invention, a fluorescent printer head is provided. The fluorescent printer head includes an anode substrate and first and second anode arrays arranged in a manner to extend in a longitudinal direction of the anode substrate and be spaced from each other at a predetermined interval in a direction perpendicular to the longitudinal direction. The first and second anode arrays each are formed of a plurality of anode dots and arranged so that the anode dots of the first anode array and the anode dots of the second anode array are not oppositely aligned with each other in the longitudinal direction of the anode substrate. Each one of the anode dots of the first anode array and each one of the anode dots of the second anode array which are adjacent to each other are commonly connected together. The fluorescent printer head also includes a drive means for driving each of the anode dots of the anode arrays, a first filamentary cathode arranged above the first anode array, a second filamentary cathode arranged above the second anode array, a shield electrode which is arranged between the first cathode and the second cathode so as to separate a space above the first anode array and a space above the second anode array from each other and to which a zero potential or a positive potential is applied, a first control electrode which is arranged on a side of arrangement of the first cathode based on the shield electrode and to which a selection voltage for selecting the first anode array is applied, and a second control electrode which is arranged on a side of arrangement of the second cathode based on the shield electrode and to which a selection voltage for selecting the second anode array is applied.

In a preferred embodiment of the present invention, the shield electrode is constructed of a plate-like electrode member arranged above the anode substrate so as to be substantially vertical with respect to the anode substrate.

In a preferred embodiment of the present invention, the shield electrode is positioned at an upper end thereof above the first and second cathodes.

In a preferred embodiment of the present invention, the first and second control electrodes are so arranged that the first cathode is interposed between at least a part of the first control electrode and the shield electrode and the second cathode is interposed between at least a part of the second control electrode and the shield electrode.

In a preferred embodiment of the present invention, the first and second control electrodes are arranged at least a part thereof above the first and second cathodes.

In a preferred embodiment of the present invention, the fluorescent printer head further includes a second insulating substrate arranged opposite to the anode substrate, wherein the first and second control electrodes are mounted on an inner surface of the insulating layer through an insulating layer.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

BRIEF DESCRIPTION OF THE PREFERRED EMBODIMENT

Figure 1:
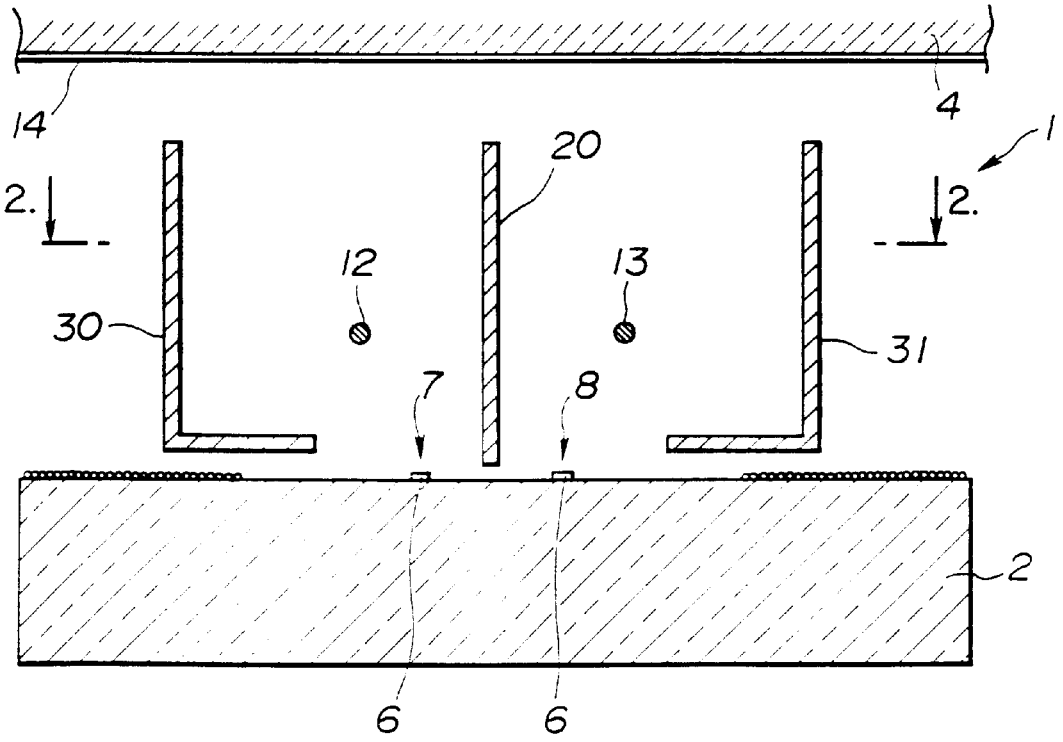
FIG. 1 is a sectional view showing an embodiment of a fluorescent printer head according to the present invention.

Now, a fluorescent printer head according to the present invention will be described hereinafter with reference to FIGS. 1 to 5(*e*).

Referring first to FIGS. 1 to 4, an embodiment of a fluorescent printer head according to the present invention is illustrated.

A fluorescent printer head of the illustrated embodiment which is generally designated at reference numeral 1 includes an envelope 5 of a box-like shape which is formed by sealedly joining an anode substrate 2, side plates 3 and a rear substrate 4 to each other by means of sealing glass and then evacuated to a high vacuum.

The anode substrate 2 is formed on an inner or upper surface thereof with first and second anode arrays 7 and 8 in a manner to extend in a longitudinal direction of the anode substrate 2 or a first direction. The first and second anode arrays 7 and 8 each are constituted by a plurality of anode dots 6. The anode dots 6 each include a frame-like conductive film and a phosphor layer deposited on the frame-like conductive film. The first and second anode arrays 7 and 8 are arranged so as to be spaced from each other at a predetermined interval in a direction perpendicular to the longitudinal direction of the anode substrate 2 or the first direction. The anode dots 6 of the first anode array 7 and those of the second anode array 8 are arranged so as to be kept from being oppositely aligned with each other in the direction perpendicular to the longitudinal direction of the substrate or the first direction. In other words, the anode dots of the first and second anode arrays 7 and 8 are generally arranged in a zigzag or offset manner in the first direction. Also, each one of the anode dots 6 of the first anode array 7 and each one of the anode dots 6 of the second anode array 8 which are adjacent to each other are commonly connected together and led out to one side of each of the anode arrays 7 and 8 by means of anode wirings 9 arranged on the anode substrate 2.

The fluorescent printer head 1 is constructed into a dynamic drive structure. As described above, each one of the anode dots 6 of the first anode array 7 and each one of the anode dots 6 of the second anode array 8 which are adjacent to each other are commonly connected together and led out to one side of each of the anode arrays 7 and 8 by means of the anode wirings 9 on the anode substrate 2. The envelope 5 is provided therein with ICs 10 each acting as an anode drive means in a manner to be arranged outside one of the anode arrays 7 and 8. The wiring conductors led out of the anode dots are connected to terminals of the ICs 10 corresponding thereto, respectively. Such construction permits the number of ICs 10 required to be reduced to half as compared with the conventional fluorescent printer head of the static drive type described above.

The anode substrate 2 is provided on the inner or upper surface thereof with a flat control electrode 11. The flat control electrode 11 is made of a conductive film of aluminum or the like and arranged on the same plane as the anode dots 6 while surrounding the anode dots 6 and anode wirings 9. During driving of the fluorescent printer head 1, a positive voltage is kept applied to the flat control electrode 11, to thereby render an electric field therearound constant.

The envelope 5 is also provided therein with first and second filamentary cathodes 12 and 13, which are stretchedly arranged above the first and second anode arrays 7 and 8 so as to extend along the anode arrays 7 and 8 or in the above-described first direction, respectively. Also, the rear substrate 4 is formed on an inner surface thereof with a light-permeable conductive film or NESA film 14 acting as an antistatic means. The NESA film 14 is formed thereon with an anti-reflection layer which functions to absorb light emitted from the anode arrays 7 and 8 to prevent reflection of the light toward the anode arrays.

The fluorescent printer head 1 also includes a shield electrode 20 arranged between the first anode array 7 and the second anode array 8. The shield electrode 20 is made in the form of a flat electrode member and arranged so as to be substantially perpendicular to the anode substrate 2. Also, the shield electrode 20 is positioned at a lower end thereof above the anode substrate 2 with a micro-interval being defined therebetween. In the illustrated embodiment, the micro-interval may be set to be as small as about 0.3 mm. An insulating layer may be interposedly arranged between the lower end of the shield electrode 20 and the anode substrate 2. Further, the shield electrode 20 is so arranged that an upper end thereof is positioned above the first and second cathodes 12 and 13, resulting in electrons emitted from the cathodes 12 and 13 from traveling beyond the shield electrode 20.

Figure 2:
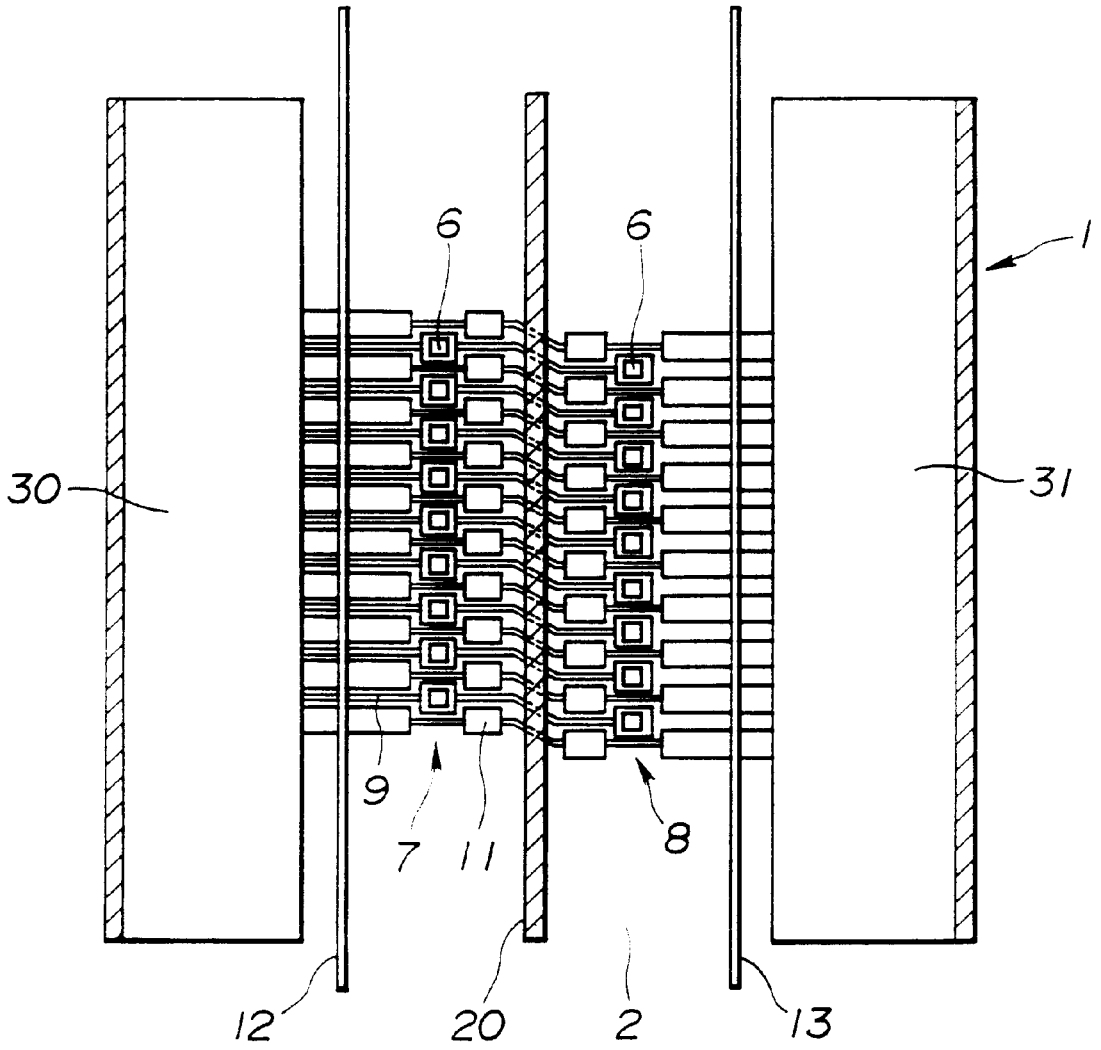
FIG. 2 is a sectional view taken along line A—A of FIG. 1.
Figure 3:
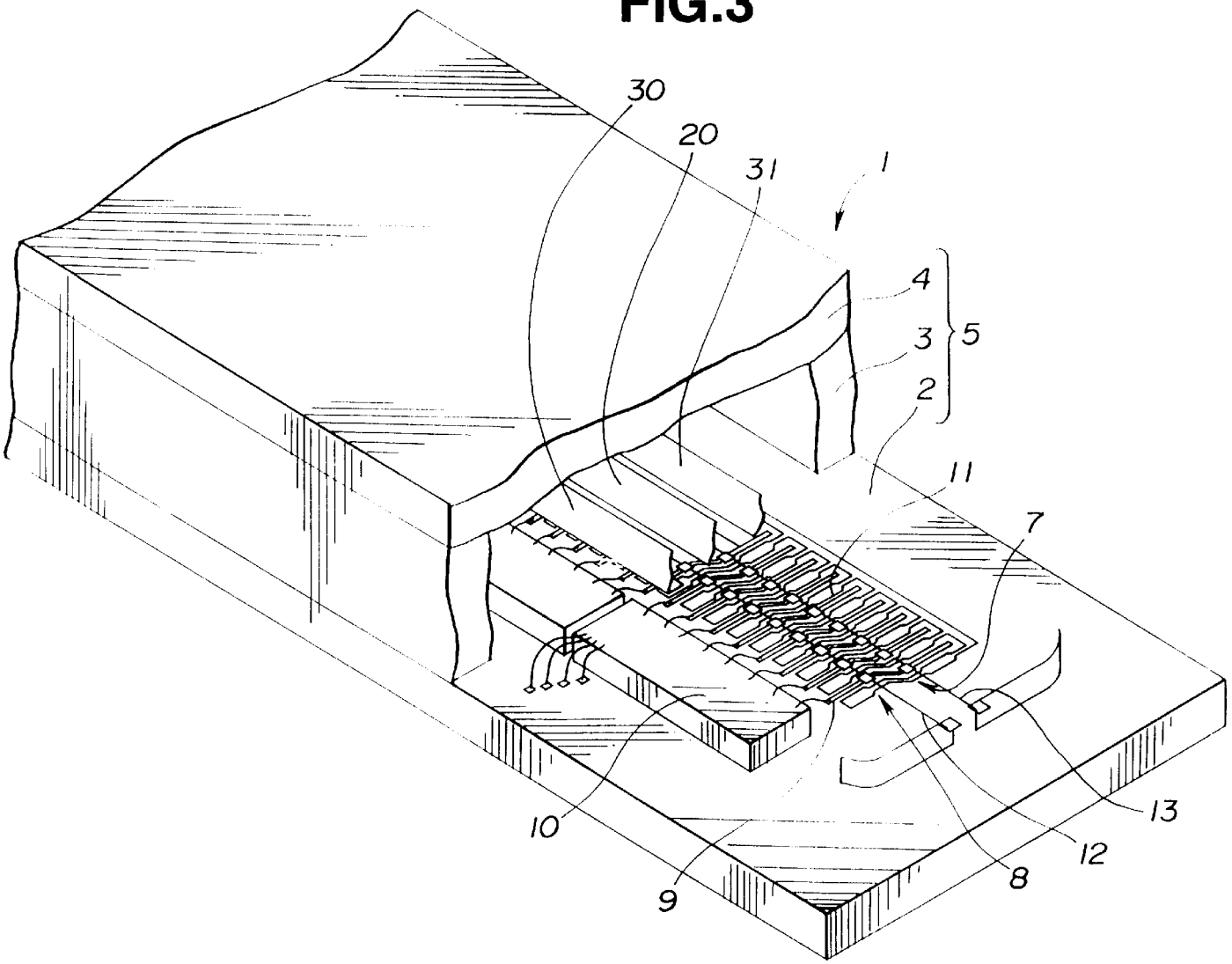
FIG. 3 is a fragmentary partly cut-away perspective view of the fluorescent printer head shown in FIG. 1.

The fluorescent printer head 1 of the illustrated embodiment also includes a first control electrode 30 arranged in a space defined on a side of the first cathode 12 based on the shield electrode 20, as well as a second control electrode 31 arranged in a space defined on a side of the second cathode 13 based on the shield electrode 20, as shown in FIGS. 1 to 3. The first and second control electrodes 30 and 31, as shown in FIG. 1, each are formed into a substantially L-shape in section taken in a direction perpendicular to the above-described first direction, resulting in including a vertical plate portion and a horizontal flange plate portion. The first and second control electrodes 30 and 31 each are so arranged that the flange plate portion is rendered parallel to the inner surface of the anode substrate 2 while defining a micro-interval between the flange plate portion of each of the control electrodes 30 and 31 and the anode substrate 2. In the illustrated embodiment, the microinterval may be set to be as small as about 0.5 mm. The first and second control electrodes 30 and 31 each are arranged at an upper end thereof above the cathodes 12 and 13. Thus, the cathodes 12 and 13 are surrounded by the shield electrode 20 and both control electrodes 30 and 31. In the illustrated embodiment, the cathodes 12 and 13 are arranged between the shield electrode 20 and the control electrode 30 and between the shield electrode 20 and the control electrode 31, respectively.

Now, the manner of driving of the fluorescent printer head 1 of the illustrated embodiment thus constructed will be described hereinafter.

The first and second cathodes 12 and 13 are kept fed with electric power, resulting in emission of electrons therefrom being continued. Also, a zero voltage or a positive voltage is kept applied to the shield electrode 20 and a positive voltage is kept applied to the flat control electrode 11. Pairs of dots each consisting of each one of the anode dots 6 of the first anode array 7 and each one of the anode dots 6 of the second anode array 8 which are adjacent to each other are driven in order by the ICs 10. Then, a selection signal is fed to the first control electrode 30 or second control electrode 31 in synchronism with scanning of the anode dots. For example, a positive voltage is applied to the first control electrode 30 in synchronism with a scanning timing of the anode arrays, during which a negative voltage is applied to the second control electrode 31. This permits electrons to enter between the first control electrode 30 having the positive voltage applied thereto and the shield electrode 20, resulting in impinging on the anode dots 6 of the first anode array 7 which have fed with the drive signal. The electrons are kept from entering between the second control electrode 31 having the negative voltage applied thereto and the shield electrode 20, because the electrons are obstructed by the electric field.

The shield electrode 20 is arranged so as to upwardly extend at the upper end thereof from the cathodes 12 and 13, to thereby prevent electrons from flowing into the anode array of which luminescence is not intended or desired. The shield electrode 20 having the positive voltage applied thereto prevents a potential of the control electrode having the negative voltage applied thereto from affecting the anode array of which luminescence is intended or desired and which is positioned on the side of the control electrode having the positive voltage applied thereto, so that the anode dots 6 on the side of the control electrode having the positive voltage applied thereto may be selectively excited for luminescence.

A decrease in width of a space between the upper end of the shield electrode 20 and each of the control electrodes 30 and 31 permits a reduction in reactive current flowing to the anode arrays 7 and 8 between the shield electrode 20 and the control electrodes 30 and 31 and to the control electrodes 30 and 31.

Luminescence of the anode dots 6 is guided forwardly of the anode substrate 2 through the light-permeable anode conductor and anode substrate 2. The anti-reflection layer arranged on the inner surface of the rear substrate 4 absorbs light emitted from the anode dots 6 to prevent reflection of light toward the anode dots. Absence of the anti-reflection layer causes light returning to the anode side to leak from between the anode dots 6 and the flat control electrode 11 toward the anode substrate 2, resulting in deterioration in display contrast of the luminous dots or anode dots 6.

In the fluorescent printer head 1 of the illustrated embodiment, as described above, the shield electrode 20 is provided between the anode arrays 7 and 8 having the anode dots 6 arranged in an offset manner and the control electrodes 30 and 31 are respectively arranged for the anode arrays 7 and 8, wherein the anode arrays 7 and 8 are subject to dynamic driving and selected by the control electrodes 30 and 31. Such construction of the fluorescent printer head 1 ensures smooth selection of the anode arrays 7 and 8 during the dynamic driving, eliminates nonuniformity in luminance of the anode dots 6 of the anode arrays 7 and 8, and accomplishes downsizing of the fluorescent printer head 1 and a reduction in manufacturing cost thereof due to a reduction in the number of ICs required.

In the illustrated embodiment, the shield electrode 20 and first and second control electrodes 30 and 31 each may be provided on a surface thereof with an anti-reflection film. This further enhances absorption of light emitted from the anode dots 6, to thereby further improve the display contrast.

Figure 4:
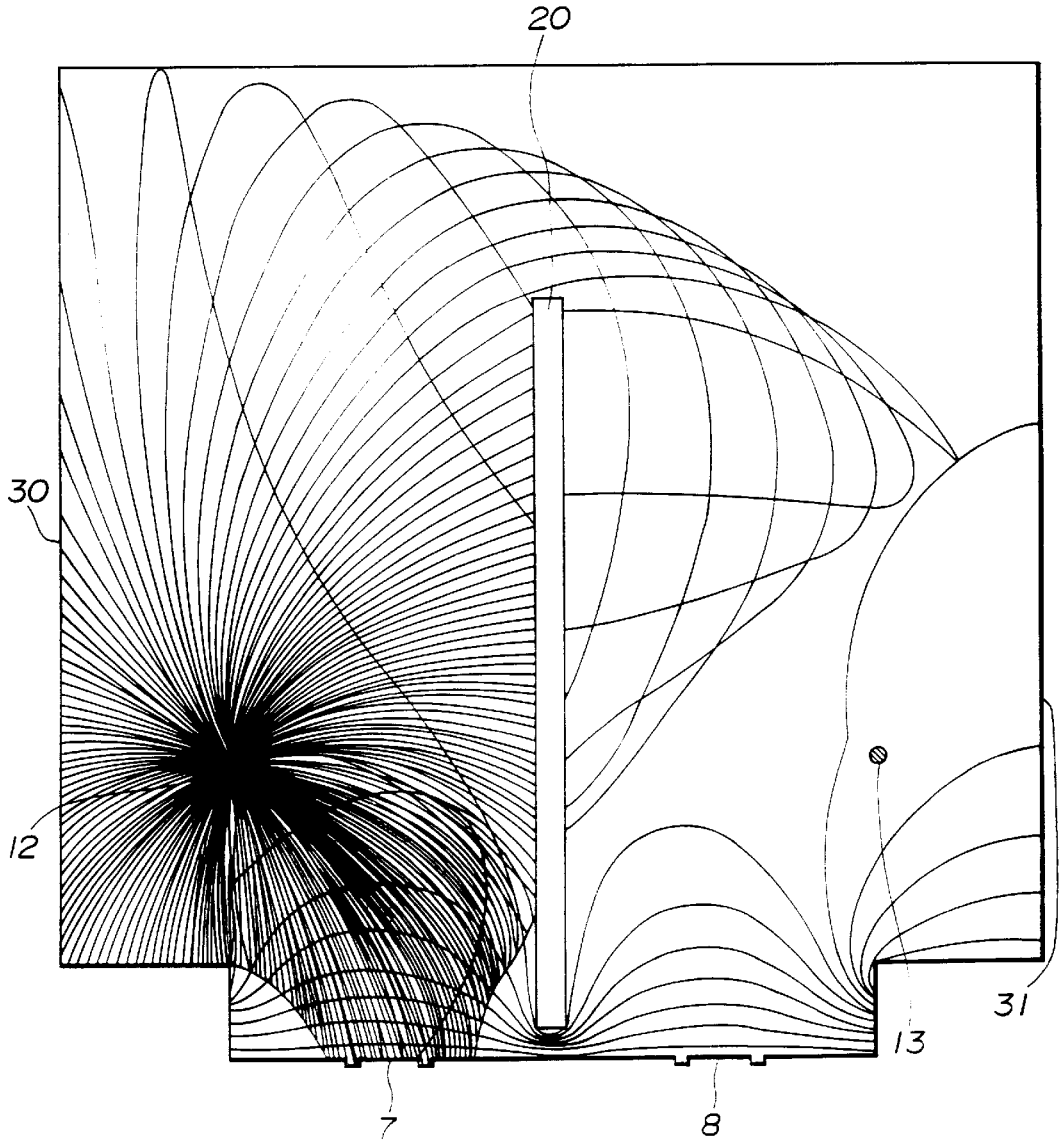
FIG. 4 is a diagrammatic view showing analysis of an electric field in the fluorescent printer head shown in FIG. 1.
Figure 5A:
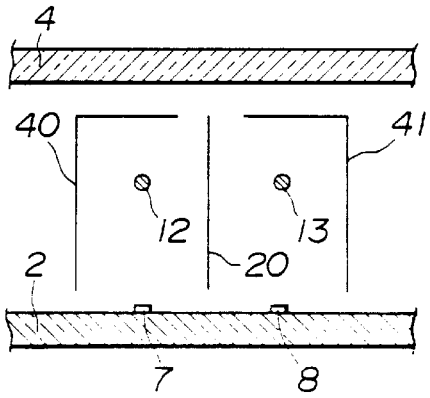
FIGS. 5(*a*) to 5(*e*) each are a schematic sectional view showing a configuration of control electrodes which may be incorporated in the fluorescent printer head shown in FIG. 1.
Figure 5D:
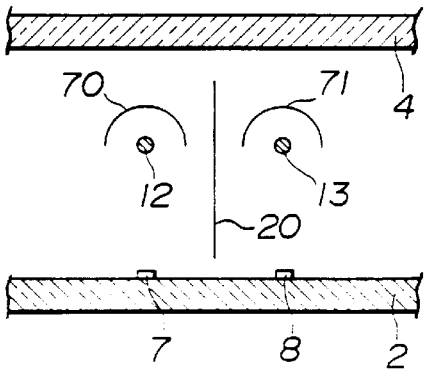
Figure 5B:
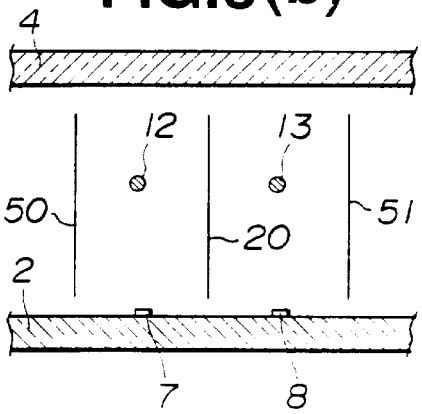
Figure 5E:
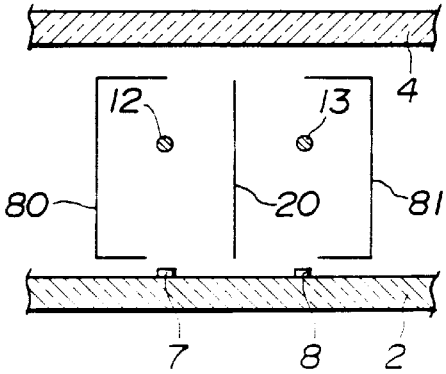
Figure 5C:
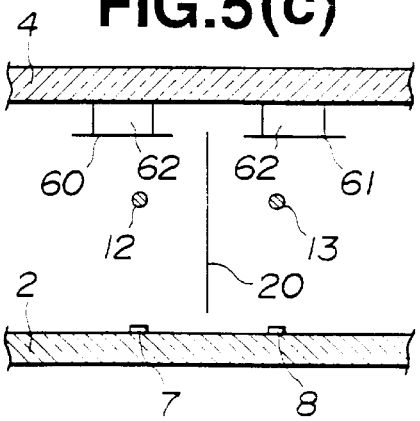
Figure 6:
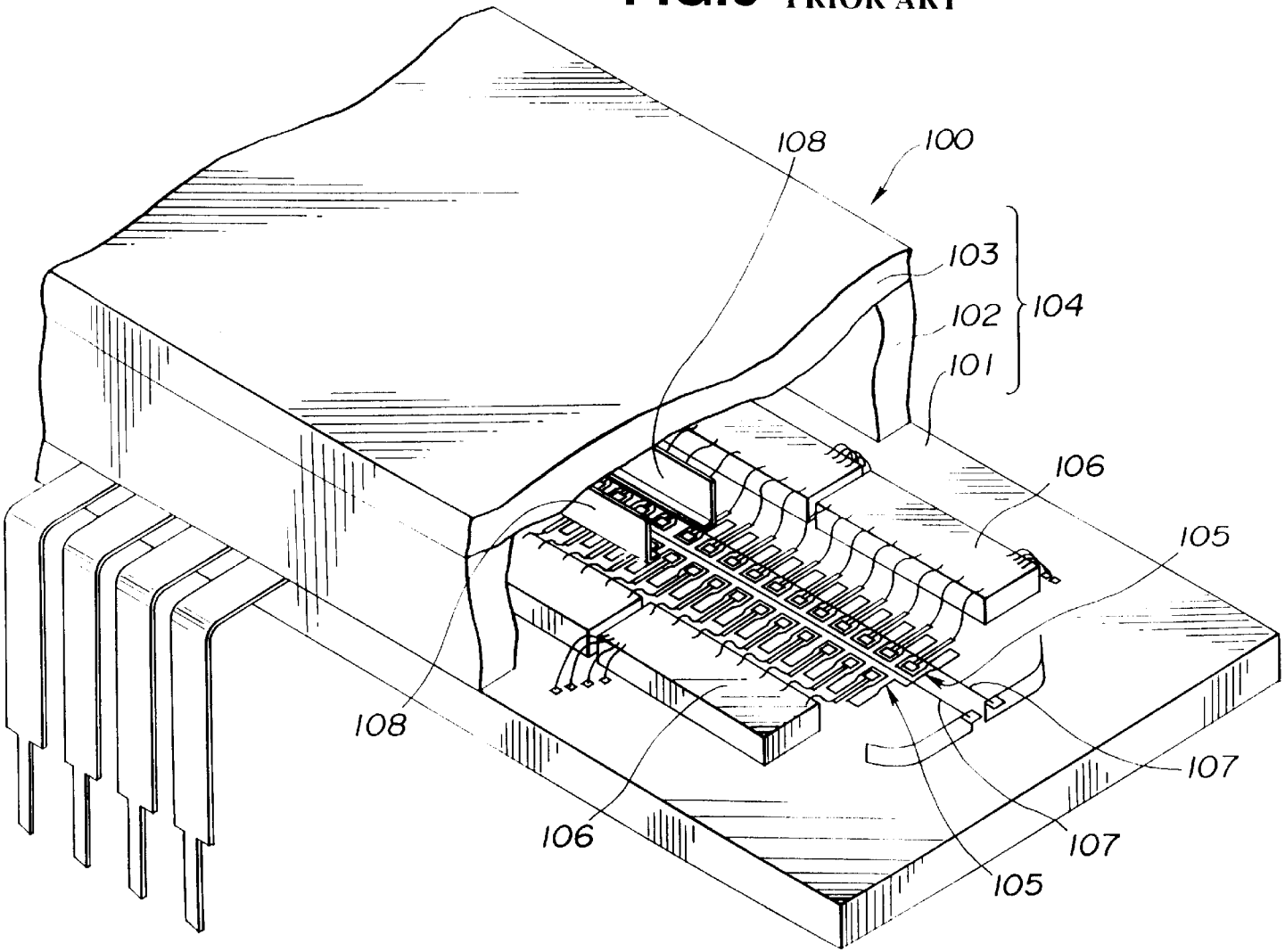
FIG.6 PRIOR ART
FIG. 6 is a fragmentary partly cut-away perspective view showing a conventional fluorescent printer head.

Application of a positive potential to the first control electrode 30 and application of a negative potential to the second control electrode 31 permit such an electric field and a locus of electrons as shown in FIG. 4 to be formed in the envelope 5. As will be noted from FIG. 4, electrons emitted from the cathode 12 on the side of the first control electrode 30 are substantially caused to impinge on the anode array 7 on the side of the control electrode 30 while being kept from impinging on the adjacent anode array 8 beyond the shield electrode 20. More particularly, electrons emitted from the cathode on the side of the anode array of which luminescence is desired is prevented from going over the shield electrode 20 by an electric field due to a negative potential applied to the opposite control electrode. Also, the cathode 13 on the side of the second control electrode 31 is surrounded by a negative electric field of the second control electrode 31, to thereby be kept from emitting electrons. Thus, the illustrated embodiment substantially fully prevents any unnecessary luminescence, to thereby ensure luminescence of only the anode dots 6 selected.

Referring now to FIGS. 5(*a*) to 5(*e*), modifications of the control electrodes are illustrated. Control electrodes 40 and 41 shown in FIG. 5(*a*) are formed into the same shape as the control electrodes 30 and 31 described above and arranged in an inverted manner. Control electrodes 50 and 51 shown in FIG. 5(*b*) each are formed of a flat electrode material into the same shape and size as the shield electrode 20. Control electrodes 60 and 61 shown in FIG. 5(*c*) each are formed into a flat shape and mounted on the inner surface of the rear substrate 4 through an insulating layer 62. Thus, it will be noted that the illustrated embodiment is not limited to mounting of the control electrodes on the side of the anode substrate 2. Control electrodes 70 and 71 shown in FIG. 5(*d*) each are formed into a semi-cylindrical shape and the cathodes 12 and 13 are positioned at a center of the control electrodes 70 and 71, respectively. Control electrodes 80 and 81 shown in FIG. 5(*e*) each are formed into a substantially U-shape and so arranged that an opening thereof inwardly faces.

It was found that the control electrodes 30 and 31 described above and the control electrodes 40 and 41 shown in FIG. 5(*a*) exhibit increased mechanical strength as compared with the control electrodes 50 and 51 of a shape like a flat plate shown in FIG. 5(*b*). Also, the control electrodes 80 and 81 of a U-shape shown in FIG. 5(*e*) exhibit mechanical strength larger-than the control electrodes 40 and 41 shown in FIG. 5(*a*).

In the illustrated embodiment, the control electrodes so function that a positive electric field generated by the control electrode on the luminescence side surrounds the cathode to derive electrons from the cathode, to thereby impinge the electrons on the anode dots and a negative electric field generated by the control electrode on the non-luminescence side prevents the cathode from emitting electrons. Such a function of the control electrodes depends on an area of the control electrodes, an interval between the control electrodes and the cathode, and the like. The control electrodes may be formed into a shape which does not interfere impingement of electrons on the anode dots and permits a negative electric field to be produced around the cathodes.

The fluorescent printer head of the illustrated embodiment constructed as described above may be suitably used as an optical printer head for forming an optical latent image on a photosensitive drum of any printing equipment, an optical printer head for transferring a video image on a developing paper or a film, an optical printer head for an optical recording equipment and the like.

As can be seen from the foregoing, the fluorescent printer head of the present invention is so constructed that the shield electrode is provided between the anode arrays having the anode dots arranged in an offset manner and the control electrodes are respectively arranged for the anode arrays, wherein the anode arrays are subject to dynamic driving and selected by the control electrodes. Such construction of the fluorescent printer head ensures smooth selection of the anode arrays during the dynamic driving. Also, it eliminates non-uniformity in luminance of the anode dots of the anode arrays and accomplishes downsizing of the printer head and a reduction in manufacturing cost thereof due to a reduction in the number of ICs required.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent printer head comprising:

an anode substrate;

first and second anode arrays arranged in a manner to extend in a longitudinal direction of said anode substrate and be spaced from each other at a predetermined interval in a direction perpendicular to said longitudinal direction;

said first and second anode arrays each being formed of a plurality of anode dots and arranged so that said anode dots of said first anode array and said anode dots of said second anode array are not oppositely aligned with each other in the longitudinal direction of said anode substrate;

each one of said anode dots of said first anode array being connected to an adjacent non-aligned one of said anode dots of said second anode array;

a drive means for driving each of said anode dots of said anode arrays;

a first filamentary cathode arranged above said first anode array;

a second filamentary cathode arranged above said second anode array;

a shield electrode which is arranged between said first cathode and said second cathode so as to separate a space above said first anode array and a space above said second anode array from each other and to which a zero potential or a positive potential can be applied;

a first control electrode which is arranged on a same side of said shield electrode as said first cathode and to which a selection voltage for selecting said first anode array can be applied; and a second control electrode which is arranged on a same side of said shield electrode as said second cathode and to which a selection voltage for selecting said second anode array can be applied.

2. A fluorescent printer head as defined in claim 1, wherein said shield electrode is constructed of a plate-like electrode member arranged above said anode substrate so as to be substantially vertical with respect to the anode substrate.

3. A fluorescent printer head as defined in claim 2, wherein said shield electrode extends above said first and said second anode arrays so as to be higher above said arrays than the cathodes.

4. A fluorescent printer head as defined in claim 1, wherein said first and second control electrodes are so arranged that said first cathode is interposed between at least a part of said first control electrode and said shield electrode and said second cathode is interposed between at least a part of said second control electrode and said shield electrode.

5. A fluorescent printer head as defined in claim 1, wherein said first and second control electrodes are such that at least a part thereof is above said first and second cathodes.

6. A fluorescent printer head as defined in claim 5, further comprising a second substrate arranged opposite to said anode substrate;

said first and second control electrodes being mounted on an inner surface of said second substrate through an insulating layer.

* * * * *